US007870897B2

(12) United States Patent
Telfer

(10) Patent No.: US 7,870,897 B2
(45) Date of Patent: Jan. 18, 2011

(54) DUAL FUNCTION CLEANING TOOL

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 0 days.

(21) Appl. No.: 12/494,003

(22) Filed: Jun. 29, 2009

(65) Prior Publication Data

US 2009/0255665 A1 Oct. 15, 2009

Related U.S. Application Data

(63) Continuation of application No. 10/550,531, filed as application No. PCT/GB2004/001193 on Mar. 19, 2004, now Pat. No. 7,559,374.

(30) Foreign Application Priority Data

Mar. 25, 2003 (GB) ..... 0306821.0

(51) Int. Cl.
*E21B 37/00* (2006.01)

(52) U.S. Cl. ..... 166/174; 166/172; 166/173

(58) Field of Classification Search ..... 166/311, 166/170, 172, 174
See application file for complete search history.

(56) References Cited

U.S. PATENT DOCUMENTS

| | | | | |
|---|---|---|---|---|
| 2,275,939 | A * | 3/1942 | Baker | 166/173 |
| 4,648,447 | A * | 3/1987 | Bishop et al. | 166/173 |
| 2005/0028982 | A1 * | 2/2005 | Howlett et al. | 166/310 |

* cited by examiner

*Primary Examiner*—William P Neuder
*Assistant Examiner*—Cathleen R Hutchins
(74) *Attorney, Agent, or Firm*—Osha Liang LLP

(57) ABSTRACT

A cleaning tool for cleaning a liner top in a well bore. The tool includes cleaning elements, typically scrapers, which are arranged eccentrically to an axial bore through the tool. The elements are biased outwardly to contact an inner surface of a polished bore receptacle (PBR) at a position with a curvature to match the PBR and to present leading edges of each element when positioned at a surface of a neighbouring casing. The tool may further provide a top dress mill and act as a packer actuator sub. This provides a tool which performs a number of functions on a single trip in a well bore.

12 Claims, 3 Drawing Sheets

DUAL FUNCTION CLEANING TOOL

CROSS-REFERENCE TO RELATED APPLICATIONS

The present application is a continuation of U.S. application Ser. No. 10/550,531 ("the '531 application"), filed on Jul. 12, 2006. Accordingly, this application claims benefit the '531 application under 35 U.S.C. §120. The disclosure of the '531 application is hereby incorporated by reference in its entirety.

BACKGROUND OF DISCLOSURE

1. Field of the Disclosure

The present invention relates to downhole cleaning tools for use in oil and gas wells and in particular, though not exclusively, to a dual function cleaning tool adapted for cleaning a polished bore receptacle (PBR) and neighbouring casing on the same trip as setting a liner including the PBR.

2. Background Art

When a liner is cemented into casing located in a well bore, the PBR located at the top of the liner together with that part of the casing immediately above the PBR (herein referred to as the neighbouring casing) are susceptible to the influx of cement due to over displacement when the cement is pumped through the drill string and liner setting tool. Further when the drill string and setting tool are removed from the liner, cement and other debris located between the drill string and casing will fall back into the PBR and adhere to the neighbouring casing.

As the next stage requires the insertion of a sealing assembly into the liner, the PBR requires to have a smooth cylindrical inner bore on which an effective seal can be made. Additionally, the inner bore of the neighbouring casing is used to seal against a packer if a liner top packer is inserted, and thus requires to provide a smooth uniform cylindrical surface just above the PBR.

Consequently the presence of cement and debris at the PBR and/or the neighbouring casing provides a major problem in ensuring a successful seal. In order to overcome this problem, cleaning tools are typically run into the well bore to clean the PBR and the neighbouring casing. A trip is typically made to clean the PBR and a second trip is typically needed to clean the casing. Each trip into a well bore is both costly and time consuming.

Due to the decrease in inner bore diameter from the casing to the PBR, a single trip cannot be made into the well with a cleaning tool of a fixed diameter to clean both the PBR and casing. Cleaning tools with cleaning elements which are biased radially outwards such as that disclosed in U.S. Pat. No. 4,189,000 to Best, are inappropriate as the elements cannot be retracted at the point of entry to the PBR. Thus these tools can only clean the casing. Additionally as the cleaning elements are not located at the ends of the widest diameter of the tool, the cleaning elements cannot effectively access the neighbouring casing due to its close proximity to the narrower PBR.

It is therefore an object of the present invention to provide a cleaning tool which can provide the dual function of cleaning both the PBR and neighbouring casing on the same trip into a well bore.

It is a further object of at least one embodiment of the present invention to provide a cleaning tool which can provide the dual function of cleaning both the PBR and neighbouring casing on the same trip as the liner is set, and/or a packer is set.

It is a further object of at least one embodiment of the present invention to provide a cleaning tool which can effectively clean the inner bore of a PBR without damaging its relatively delicate inner surface while being able to effectively scrape the harder wearing inner surface of the neighbouring casing to effectively clean this also.

It is a yet further object of at least one embodiment of the present invention to provide a cleaning tool which can dress the top of the PBR while also cleaning both the PBR and the neighbouring casing on a single trip.

It is a yet further object of the present invention to provide a method of cementing a liner which includes the step of cleaning the PBR and neighbouring casing on tripping out the liner setting tool.

SUMMARY

According to a first aspect of the present invention there is provided a cleaning tool for use on a work string, the tool includes a cylindrical body having an axial bore running therethrough, and a plurality of eccentrically located cleaning elements mounted thereon, wherein at least one of the plurality of cleaning elements comprises a curved outer face that extends from a leading edge to a trailing edge of the cleaning element. The tool also includes a positioning means to move the cleaning elements in relation to the cylindrical body from a first position to a second position, wherein in the first position, the outer faces of the cleaning elements define a cylindrical surface centralized to the axial bore so that the cleaning elements are configured to provide a polishing action, and in the second position, leading edges of the cleaning elements are configured to provide a scraping action.

Preferably the cleaning elements are scrapers. Preferably also each element has an inner face and an outer face. The outer face may include one or more blades as scrapers. More preferably the cleaning element is substantially rectangular in cross-section to provide a first edge between a side and the outer face.

Preferably the plurality of elements are located in at least one band around the circumference of the body. Preferably also the elements of each band are spaced equidistantly around the body.

Preferably each element is located in a recess of the body. Preferably each recess is located longitudinally on the body, eccentrically to the axial bore. Preferably also each recess has a lip located at each longitudinal end thereof. The lip will prevent the cleaning element moving out of the recess.

Preferably the positioning means is a biasing means located between an inner surface of the recess and the inner face of the cleaning element. More preferably the biasing means is a spring. The spring may be leaf, coiled or conical as are known in the art. Preferably the spring is held in compression, biasing the element away from the body.

Preferably the outer face is curved. More preferably the curvature of the outer face is greater than a curvature of the cylindrical body.

Preferably the curvature of the outer faces of the elements are selected such that in a first position wherein the outer faces are proud of the body, the outer faces define a cylindrical surface centralised to the axial bore. Preferably also in a second position wherein the outer faces are located outwardly of the first position, the first edge of each element provides a leading edge of a scraper.

Preferably the outer face comprises a material being softer or more malleable than the material of a PBR. In this way the PBR cannot be damaged during scraping. The material of the outer face may be brass.

Preferably also the elements include a profiled end. The profiled end may be tapered. In this way, they allow a sleeve, such as a PBR, to move the elements inwards towards the body if the tool is inserted into a PBR. Alternatively, the profiled end may provide a stop. In this way, the stop which may be a shoulder, prevents movement of the tool into a PBR whose top overlaps the stop.

Preferably the stop comprises a ledge facing the PBR. Advantageously the ledge comprises a mill. In this way a topdress mill is provided for the PBR.

According to a second aspect to the present invention there is provided a method of cleaning a liner top, the method comprising the steps:

(a) inserting a tool according to the first aspect into a liner;
(b) running the tool and liner together into a well bore;
(c) setting the liner at a casing in the well bore;
(d) rotating and/or reciprocating the tool to clean an inner surface of a PBR on the liner with the cleaning elements;
(e) pulling the tool from the PBR, so that the cleaning elements move outwardly to contact neighbouring casing at the liner top; and
(f) rotating and/or reciprocating the tool to clean an inner surface of the neighbouring casing with the leading edges of the cleaning elements.

This is achieved on a single trip into the well bore.

The method may include the further step of tripping the tool from the well bore.

The method may include the step of attaching the tool to a liner setting tool, so that the tool is tripped out with the setting tool. In this way the casing is cleaned as the setting tool is tripped from the well.

Preferably the method further includes the step of selecting the curvature of the outer faces to be no greater than the curvature of the inner surface of the PBR. In this way, at the first position, the curvature of the outer faces substantially match the curvature of the inner surface of the PBR.

Preferably also the method may include the step of running the tool back into the PBR.

Preferably the method may include the step of dressing a top of the PBR.

Preferably the method may include the step of setting down weight on the tool to thereby set a packer.

BRIEF DESCRIPTION OF DRAWINGS

An embodiment of the present invention will now be described, by way of example only, with reference to the accompanying drawings of which.

DETAILED DESCRIPTION

Figure 1:
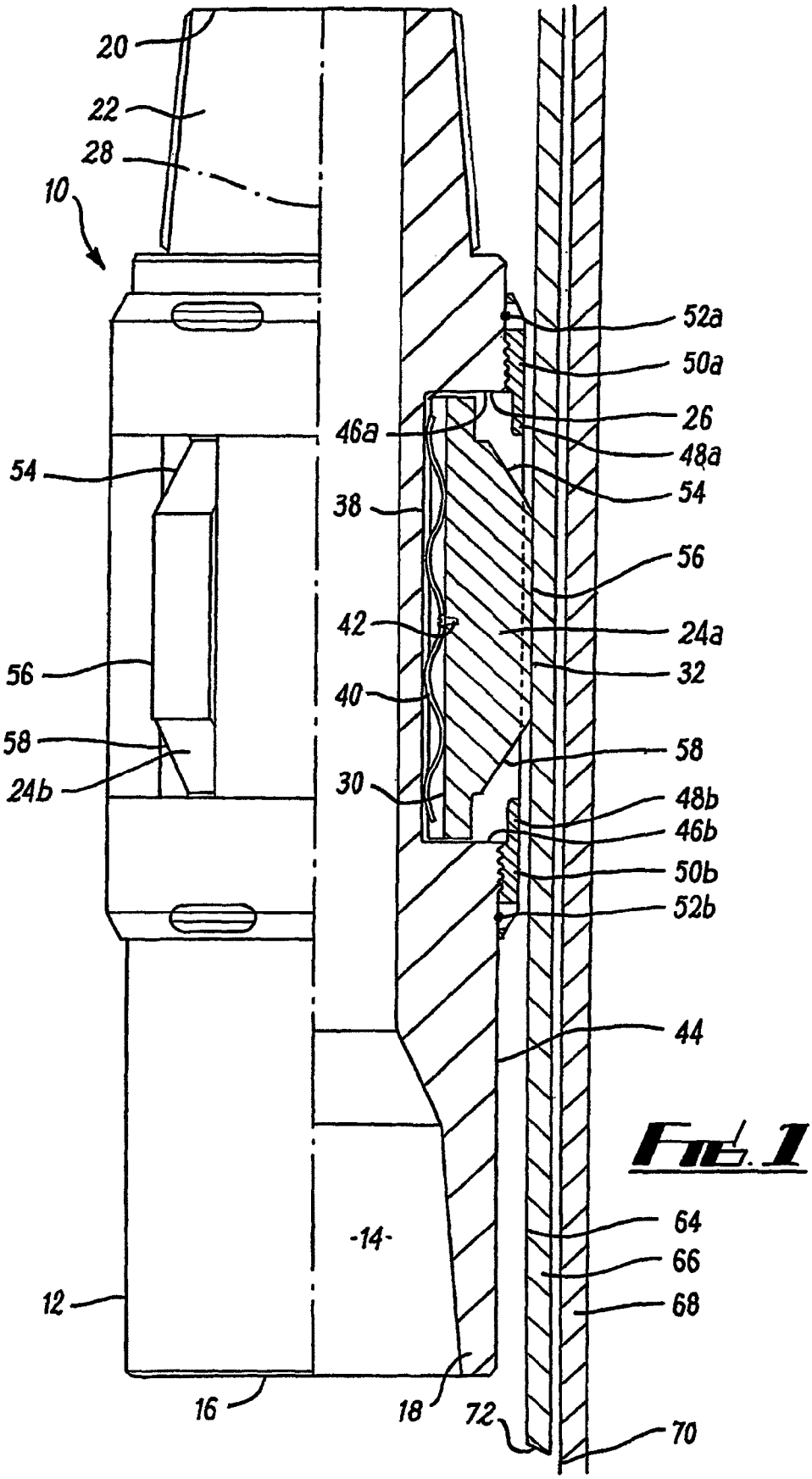
FIG. 1 is a part cross-sectional schematic view through a cleaning tool according to an embodiment of the present invention.

Reference is initially made to FIG. 1 of the drawings which illustrates a cleaning tool, generally indicated by reference numeral 10, according to an embodiment of the present invention. Tool 10 comprises a cylindrical body 12 having an axial bore 14. At an upper end 16 of the tool 10 is located a box section 18 for connection of the tool 10 to a work string or a liner setting tool (not shown). At a lower end 20 of the tool 10 is located a pin section 22 for connection of the tool 10 onto a lower section of work string or drill string (not shown).

Three cleaning elements 24 are arranged equidistantly around the body 12. Each element 24 is located in a recess 26. Each recess 26 is rectangular and arranged on the body 12 to be eccentric with the centre 28 of the bore 14. This is best seen with the aid of FIG. 2. Each recess 26 is offset from a radius drawn from the centre 28. Thus a back surface 38 of the recess 26 is not perpendicular to a radius drawn from the centre 28, through the centre of the surface 38, and to the surface 44 of the body 12.

Each element 24 is generally rectangular in cross-section and includes inner face 30, an outer face 32, and longitudinal sides 34, 36 respectively. Between the inner face 30 and the back surface 38 of the recess 26 is located a linear expander in the form of a leaf spring 40. Spring 40 is attached to the element 24 by a screw 42. The spring 40 is held in compression and thus biases the element 24 away from the back surface 38 of the recess 26. In this way the front face 32 of the element 24 protrudes from the outer surface 44 of the body 12.

At each longitudinal end 46 *a,b* of the recess 26 is located a lip 48 *a,b*. Lip 48 *a,b* comprises a ring 50 *a,b* threaded onto the body 12. Ring 50 *a,b* is held in position by a lock wire 52 *a,b* as is known in the art. Thus when the tool is rotated the rings 50 *a,b* and hence the lips 48 *a,b* remain in position over the ends 46 *a,b* of the recesses. The lips 46 *a,b* limit the movement of the elements 24 away from the back surfaces 38 of the recesses 26. By this limitation on movement, the springs 40 are always held in compression.

The outer face 32 of each element 24 comprises three sections 54, 56, 58. Outer sections 54, 56 taper towards the surface 44 of the body 12 from an inner raised section 56. Inner section 56 is a scraper. The surface of section 56 comprises a blade, but alternatively could comprise a milling surface. The element 24 is made of brass. Alternatively only the middle section 56 could be made of brass, mounted on a base plate comprising the other sections 54, 58 and the inner face 30. The outer face 32 is curved in the plane perpendicular to the axial bore 14. The curvature of the outer face does not match the curvature of the surface 44 of the body 12 and is unbalanced on the face 32. In this way a leading edge 60 is formed between the outer face 32 and a side 34 of the element 24.

Figure 2:
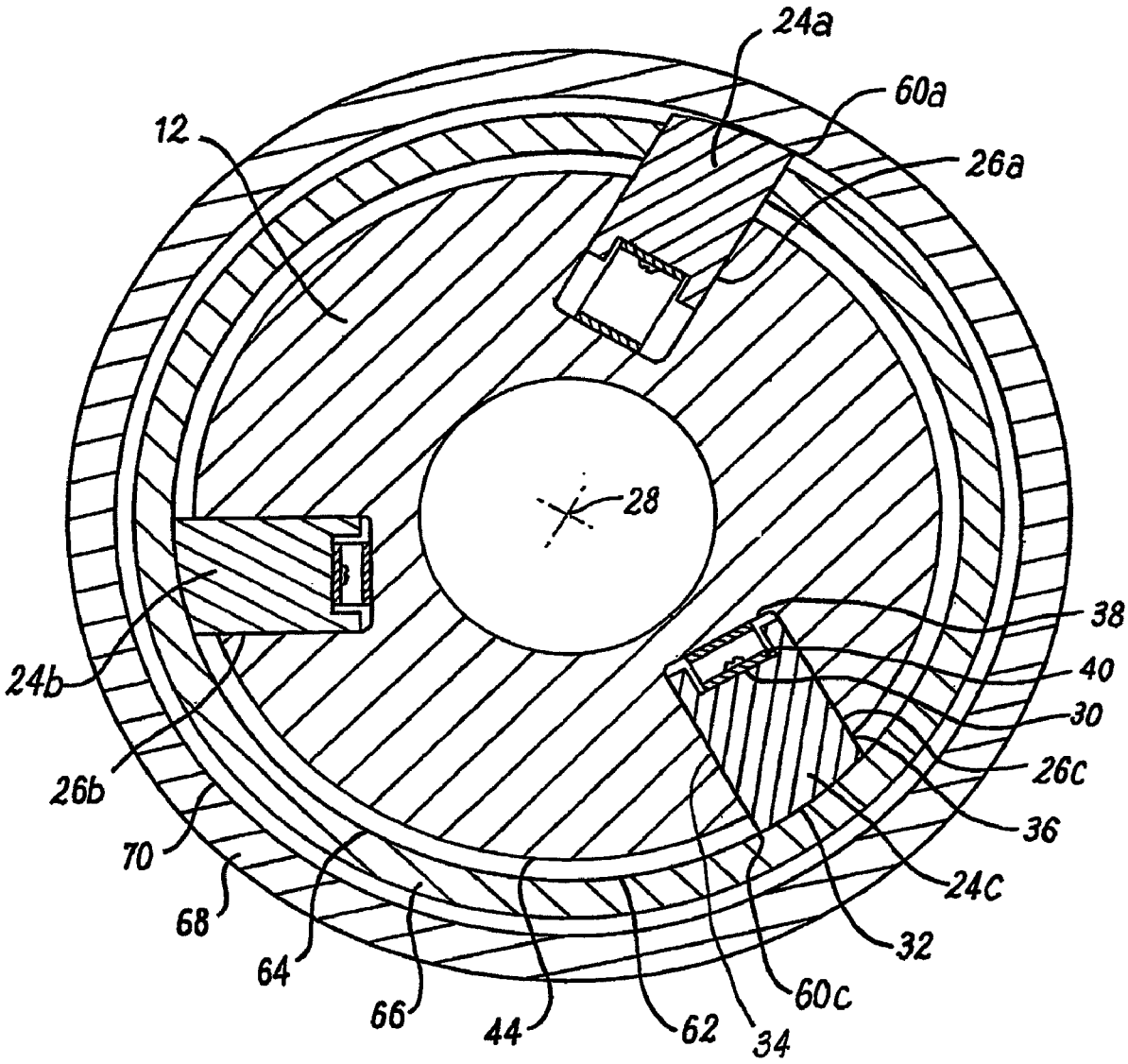
FIG. 2 is a cross-sectional schematic view through the tool of FIG. 1 at section AA.

As can be seen with the aid of FIG. 2, when the elements 24 *b,c* sit proud of the surface 44 of the body 12 at a first position, each outer face 32 lies on a circle 62 having a centre, at the centre 28 of the bore 14. In other words, in this first inner position the curved outer face 32 of the elements 24 *b,c* define a cylindrical surface concentric with the axial bore 14 having the same centre 28. As is illustrated by the element 24 *a*, in FIG. 2, once the face 32 is in any other position except the first, the leading edge 60 is presented as the point furthest from the body 12. In other words, in a second outer position the curved outer face 32 of the element 24 *a* is non-concentric with the axial bore 14 such that the leading edge 60 *a* of the element 24 *a* is configured to provide a scraping action when the leading edge 60 *a* is presented as the point furthest from the body 12.

In use, tool 10 is preferably attached to a liner setting tool (not shown). The tool 10 is mounted ahead of the setting tool on a drill string. The curvature of the faces 32 are selected to be no greater than the curvature of the inner surface 64 of the PBR 66 intended to be cleaned. Ideally, as shown in FIG. 2, surface 64 matches the circle 62 defined by the faces 32.

The tool 10 is inserted in the PBR 66 of the liner to be set in casing 68. The tapered section 58, of the elements 24 allow the elements 24 to compress into the recesses 26. The tool 10 can then slide into the PBR 66 and be held in place by the faces 32 being biased against the inner surface 64 of the PBR 66. As the faces 32 comprise of brass, which is a softer material than the steel typically used for the PBR 66, the elements 24 will not damage the smooth surface 64 of the PBR 66. With the tool 10 located in the PBR 66, the liner is run in the well and set using the setting tool as is known in the art. Cement can be pumped through the bore 14 during the cementing process to set the liner.

Once the liner is set, the work string is rotated and or reciprocated to allow the faces 32 to clean the inner surface 64 of the PBR 66 to remove any debris or cement which may have accumulated. As the faces 32 are of a softer material than the material of the PBR 66 and the curvatures are similar, the leading edges 60 sweep over the surface 64 providing a polishing action so that the surface 64 is left smooth.

Tool 10 is then withdrawn from the PBR 66 on the work string. As the elements are freed from the PBR 66, they will move away from the body 12 under the action of the springs 40 and the faces 32 will now contact the inner surface 70 of the neighbouring casing 68. As the curvature of the faces 32 does not match the curvature of the inner surface 68, the leading edge 60 will contact the surface 68. Rotation and/or reciprocation of the tool 10 will cause the edge 60 to scrape the surface 68 and thereby clean any debris or cement which rests thereon. This cleaning action is more aggressive than that used in the PBR 66. The casing 68 is thereby cleaned as the tool 10 is withdrawn from the well bore.

As the elements 24 extend from the body 12, the elements 24 can clean the neighbouring casing close to the PBR. This is particularly useful as liner top packers are generally set within two feet (50 cm) of the top 72 of the PBR 66 and the cleaning action therefore provides a good sealing surface on which to set the packer.

Any wear of the leading edge 60 will merely cause it to self-sharpen by virtue of the curvature of the face 32 always meeting the side 34 at an edge.

Figure 3:
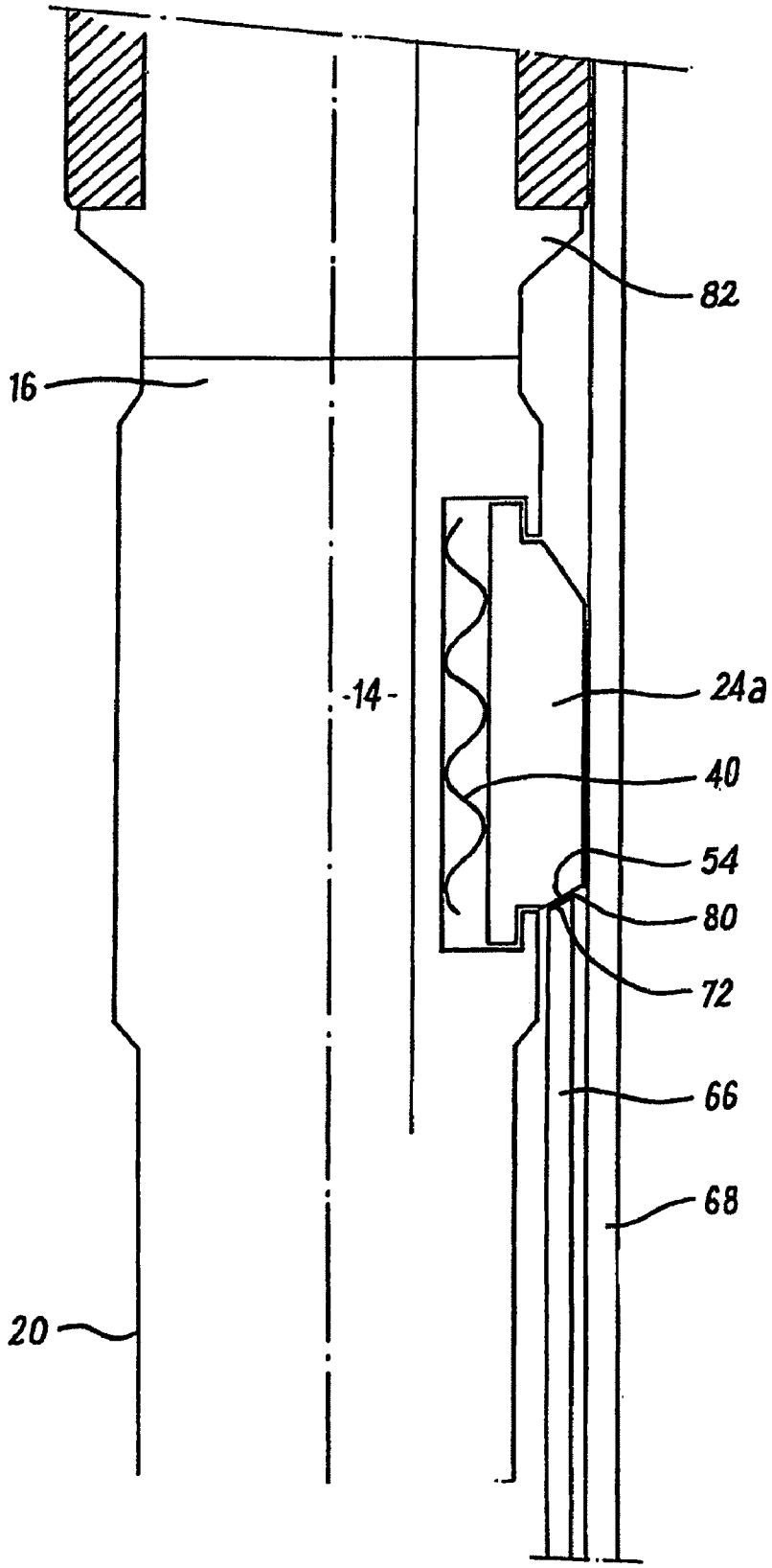
FIG. 3 is an illustration of a tool according to an embodiment of the present invention at a PBR.

In a further embodiment of the present invention the tapered sections 54, 58 can be replaced by faces arranged perpendicular to the axial bore 14. This is as illustrated in FIG. 3. Lower surface 54 is now substantially perpendicular to the bore 14 at angle to match the top 72 of the PBR 66. The surface 54 includes a mill 80 which when it contacts the top 72 of the PBR 66 can dress the top, acting as a top dress mill when the string is rotated. The mill 80 is made of a suitable material such as carbide. Further, the tool of this embodiment can be used to provide a stop at the top 72 of the PBR 66. In this way the tool 10 cannot be pushed back inside the PBR 66 and so can be used as a packer actuator sub to set a liner top packer 82, by setting down weight on the string.

A principal advantage of the present invention is that it provides tool which can clean both the PBR and particularly, the neighbouring casing, on the same trip as a liner is set.

A further advantage of the present invention is that it provides a tool with the dual function of providing a delicate cleaning action on the smooth sealing surface of the PBR and a more aggressive cleaning action on the inner surface of the casing.

Modifications may be made to the invention herein intended without departing from the scope thereof. For example, though scrapers have been illustrated as the cleaning elements bristles could also be placed on the outer faces. The number of elements could be varied and more rows of elements could be mounted on the tool. Additionally, though movement of the cleaning elements is provided by a spring, other means such as using hydraulic pressure against the inner face 30 could be used to move the cleaning elements outwards from the tool body.

What is claimed is:

1. A cleaning tool for use on a work string, the tool comprising:

a cylindrical body having an axial bore running therethrough;

a plurality of eccentrically located cleaning elements mounted thereon, wherein each of the plurality of cleaning elements comprises a curved outer face that extends from a leading edge to a trailing edge of the cleaning element; and positioning means to move the cleaning elements in relation to the cylindrical body from an inner position to an outer position, wherein in the inner position, the curved outer faces of the cleaning elements define a cylindrical surface concentric with the axial bore so that the cleaning elements are configured to provide a polishing action, and wherein in the outer position, the curved outer faces of the cleaning elements are non-concentric with the axial bore such that the leading edges of the cleaning elements are configured to provide a scraping action.

2. The cleaning tool as claimed in claim 1, wherein each cleaning element is substantially rectangular in cross-section to provide the leading first edge between a side and the outer face.

3. The cleaning tool as claimed in claim 1, wherein the plurality of elements are located in at least one band around the circumference of the body.

4. The cleaning tool as claimed in claim 1, wherein each element is located in a recess of the body, each recess being located longitudinally on the body, eccentrically to the axial bore.

5. The cleaning tool as claimed in claim 1, wherein the positioning means is a biasing means located in the recess against the cleaning element.

6. The cleaning tool as claimed in claim 5, wherein the biasing means is a spring held in compression, biasing the element away from the body.

7. The cleaning tool as claimed in claim 1, wherein a curvature of the outer face of each cleaning element is greater than a curvature of the cylindrical body.

8. The cleaning tool as claimed in claim 1, wherein the outer face comprises a material being softer or more malleable than a material of a polished bore receptacle.

9. The cleaning tool as claimed in claim 1, wherein the elements include a profiled end which is tapered.

10. The cleaning tool as claimed in claim 1, wherein the elements include a profiled end arranged to provide a stop.

11. The cleaning tool as claimed in claim 10, wherein the end comprises a mill, so that the tool acts as a top dress mill.

12. The cleaning tool as claimed in claim 1, wherein the curved outer surface is convex.

* * * * *